US006845538B2

(12) United States Patent
Nakamura

(10) Patent No.: US 6,845,538 B2
(45) Date of Patent: Jan. 25, 2005

(54) CLEANING IMPLEMENT

(75) Inventor: Kazuo Nakamura, Osaka (JP)

(73) Assignee: Yamazaki Corporation, Osaka (JP)

( * ) Notice: Subject to any disclaimer, the term of this patent is extended or adjusted under 35 U.S.C. 154(b) by 105 days.

(21) Appl. No.: 10/410,804

(22) Filed: Apr. 10, 2003

(65) Prior Publication Data

US 2003/0204923 A1 Nov. 6, 2003

(30) Foreign Application Priority Data

May 2, 2002 (JP) ..... 2002-130789

(51) Int. Cl.[7] ..... A47L 11/28; A46B 13/02
(52) U.S. Cl. ..... 15/41.1; 15/52.1; 15/4
(58) Field of Search ..... 15/27, 41.1, 44, 15/52.1, 4, 98, 50.3, 231

(56) References Cited

U.S. PATENT DOCUMENTS 3,745,605 A * 7/1973 Gitschel et al. ..... 15/400
3,789,454 A * 2/1974 Drappeu et al. ..... 15/41.1
3,906,585 A * 9/1975 Mattsson ..... 15/349
5,896,611 A * 4/1999 Haaga ..... 15/42
5,920,939 A * 7/1999 Worwag ..... 15/41.1

FOREIGN PATENT DOCUMENTS

JP 61-75255 5/1986

* cited by examiner

*Primary Examiner*—Terrence R. Till
*Assistant Examiner*—S Balsis
(74) *Attorney, Agent, or Firm*—McGlew and Tuttle, P.C.

(57) ABSTRACT

The lower end of the rotative brush 12 contacts the cleaning subject surface 26. As the driving wheels 14 roll on the cleaning subject surface 26, the rotative brush 12 rotates, while being guided by the sweep-up slope surface 10*e*1 of the slope surface forming portion 10*e*, the dust 28 on the cleaning subject surface 26 is swept up by the rotation of the rotative brush 12. The dust 28 is separated from the rotative brush 12 and received in the dust receiver 10*a*. Substantially at the same time as this, the cleaning subject surface 26 can be wiped while pressing the sheet-like wiping member 24 against the cleaning subject surface 26.

16 Claims, 8 Drawing Sheets

CLEANING IMPLEMENT

BACKGROUND OF THE INVENTION

1. Field of the Invention

The present invention relates to a cleaning implement for cleaning a floor surface or the like by using a rotative brush and a wiping member at the same time.

2. Description of the Prior Art

There is a cleaning implement for cleaning carpets that comprises wheels and a rotative brush adapted to rotate around a horizontal rotative shaft in operative association with said wheels, the cleaning implement being moved while rolling the wheels on a carpet by pushing (or pulling) a handle attached thereto, the dust on the carpet being swept up by the rotative brush rotating in operative association with the wheels, so as to receive the dust in a dust receiver in the cleaning implement.

However, when this kind of cleaning implement is used for cleaning relatively flat surfaces, such as various kinds of floor surfaces, tatami mat surfaces or the like, made of flooring material, boad, plastic material or the like, it is difficult to sufficiently sweep up the dust, with the dust and the like, particularly fine dust particles and the like often remaining on the floor surface or the like.

On the other hand, in the cleaning of various kinds of floor surfaces, an arrangement is well known wherein the wipe cleaning of a floor surface is effected by a wiping member, such as a non-woven fabric, attached to the lower surface of a mop head. The mop using such wiping member, however, lacks the ability of wiping relatively large dust particles on the floor.

Further, Japanese Utility Model Application Laid-Open No. Sho 61 (1986)-75255 discloses "a floor surface cleaner characterized in that a rotative brush having driving wheels of somewhat small diameter at both ends is rotatably mounted in a main body case opened in the lower surface in such a manner that the lower portions of said driving wheels project downward through said main body case, a dust room for receiving dust is disposed in the vicinity of the rear of said rotative brush in said main body case, and a mop having a shape for contact with a floor surface and extending substantially along the outer periphery of said rotative brush is installed in the vicinity of the rear of said rotative brush."

In this floor surface cleaner, rotation of the rotative brush causes dust on the floor surface to be swept up along the mop having a shape extending substantially along the outer periphery of the rotative brush and received in the dust room, while the mop wipes the floor surface. Some dust that is not swept up is collected by the front end of the mop by means of mop movement and stays thereon, so that it is swept up by the continuous sweep-up action produced by the rotation of the rotative brush and is received in the dust room.

The mop of this floor surface cleaner, however, is required to have a shape extending substantially along the outer periphery of the rotative brush; therefore, it is impossible to use a sheet-like wiping member, such as a non-woven fabric, or a wiping member of normal form, such as a cleaning rag, and the continuing of rotation of the rotative brush in contact with the mop tends to damage the mop and shortens the life of the wiping member.

An object of the present invention, which as been accomplished with the above prior art problems in mind, is to provide a cleaning implement capable of efficiently and reliably effecting the cleaning of various kinds of floor surface, tatami mat surfaces or the like using a wiping member without impairing its durability.

SUMMARY OF THE INVENTION

The cleaning implement of the present invention that achieves the above object is a cleaning implement comprising a rotative brush supported for rotation around a horizontal rotation axis, a driving device for rotatively driving the rotative brush, a dust receiver for receiving dust swept up by the rotation of the rotative brush, a wiping member support bottom for supporting a wiping member in such a manner the latter can be pressed against a cleaning subject surface, and a wiping member fixer for removably fixing the wiping member while supporting the latter on the wiping member support bottom, wherein said wiping member support bottom is disposed laterally of said rotative brush, said rotative brush, while supporting the wiping member on said wiping member support bottom to abut the wiping member against the cleaning subject surface, is supported with at least the lower end thereof in contact with the cleaning subject surface, said cleaning implement having a separator for separating the wiping member supported by said wiping member support bottom and said rotative brush.

Substantially at the same time as relatively large dust particles on a floor surface or the like that is a cleaning subject surface is swept up by the rotation of the rotative brush and received in the dust receiver, the floor surface or the like can be wiped by pressing the wiping member supported on the wiping member support bottom against the floor surface or the like. This means that the area of the floor surface from which relatively large dust particles that can decrease the efficiency of wiping out relatively fine dust particles are swept out is wiped by the wiping member, so that the cleaning of various kinds of floor surfaces, tatami mat surfaces or the like can be efficiently and reliably effected. The wiping member, which is removably fixed to the wiping member fixer as it is supported on the wiping member support bottom, can be exchanged whenever necessary and used, and since the rotative brush and the wiping member are separated from each other by the separator, the wiping member is prevented from being damaged or from being decreased in durability by the rotation of the rotative brush.

DETAILED DESCRIPTION OF THE INVENTION

Figure 1:
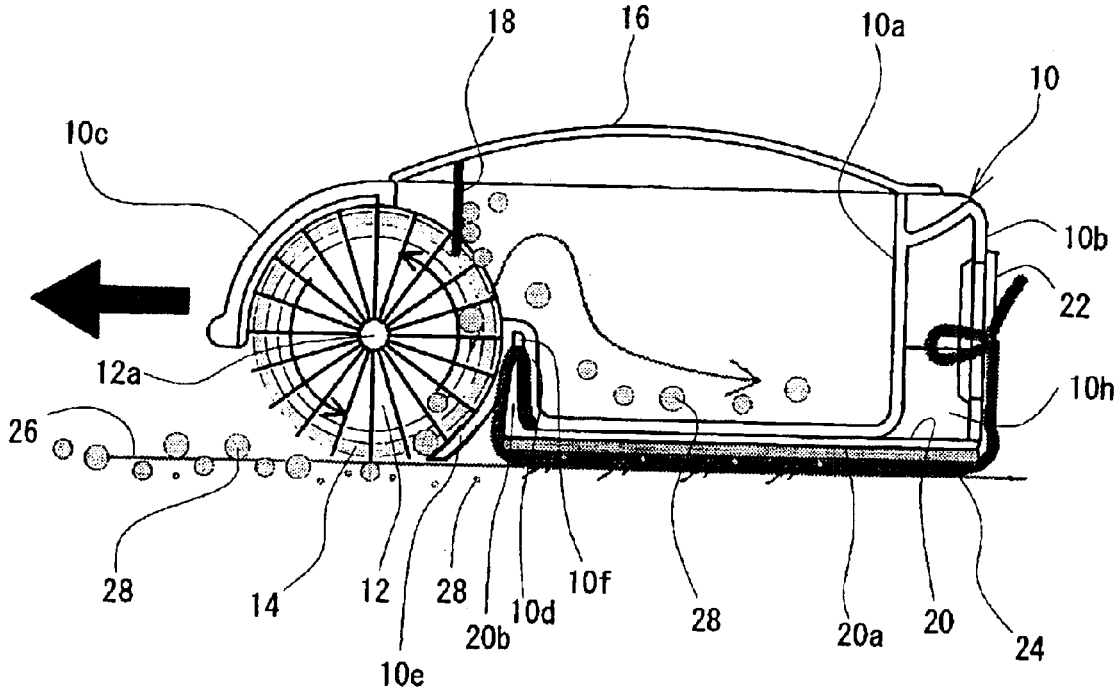
FIG. 1 is an explanatory view, in section, of the cleaning implement being used for cleaning.

The cleaning implement of the invention may be such that its base body is provided with a rotative brush, a driving device, a dust receiver, a wiping member support bottom, a wiping member fixer, a separator, and a handle or grip, etc. The base body may, for example, be substantially box-shaped or frame-like.

One or two or more rotative brushes may be installed. For example, two or more rotative brushes may be parallelly disposed, or two or more rotative brushes may be serially disposed in the direction of the rotation axis. The rotative brush may be peripherally covered, except its portion leading to the dust receiver and its portion opposed to the cleaning subject surface, with the base body of the cleaning implement or a rolling member to be later described or some other member.

The driving device may, for example, be such that the cleaning implement is provided with a rolling member such as a wheel or roller, the rolling member and rotative brush being fixed on the same rotative shaft or being operatively associated through a transmission mechanism using an endless transmission means such as an endless belt or gears or the like, so that when the cleaning implement is moved on the cleaning subject surface while rolling said rolling member on the cleaning subject surface, the rotative brush can be driven for rotation. In the case of operative association through a transmission mechanism, it is possible to make the rpm (angular velocity) of the rotative brush greater than that of the rolling member or to make the direction of rotation of the rotative brush opposite to that of the rolling member. Alternatively, for example, it is possible to drive the rotative brush for rotation by using a power source, such as an electric motor.

The direction of rotation of the rotative brush when driven by the rolling of the rolling member is preferably such that when the cleaning implement is moved on the cleaning subject surface with the wiping member support bottom following after the rotative brush in the direction orthogonal to the rotation axis of the rotative brush, the lower region of the rotative brush rotates backward. In this case, the direction of rolling of the rolling member coincides with the direction of rotation of the rotative brush, although the direction of rotation of the rotative brush may be reversed. In the case of using a driving source, it is preferable that the lower region of the rotative brush be rotated in the direction toward the place where the wiping member support bottom is positioned, although the direction may be reversed. In addition, it is possible to install rotative brushes forwardly and rearwardly of the wiping member support bottom or to install wiping member support bottoms forwardly and rearwardly of the rotative brush.

The cleaning implement of the invention preferably has a slope surface forming portion (usually, a member that extends in parallel with the rotation axis of the rotative brush) disposed on the side to which the lower region of the rotative brush advances by rotation, extending substantially along the outer periphery of the rotative brush to form a sweep-up slope surface (curved surface or planar surface) with its lower end opposed to the cleaning subject surface. The reason is that the dust on the cleaning subject surface can be reliably swept up along the sweep-up slope surface by rotation of the rotative brush. In the case where the direction of rotation of the rotative brush can be reversed by the direction of rolling of the rolling member or by something like that, a slope surface forming portion may be placed only on the side to which the lower region of the rotative brush advances by primary rotation (which, in the case where the rotative brush is driven by the rolling of the rolling member, is preferably the rotation produced when the cleaning implement is moved on the cleaning subject surface with the wiping member following after the rotative brush in the direction orthogonal to the rotation axis of the rotative brush); however, such slope surface forming portion may be placed on both sides.

It is preferable that such slope surface forming portion be vertically movably supported so that it is capable of moving upward when pushed up by a raised area on the cleaning subject surface and returning to its original position when the push-up action is removed. In this case, the slope surface forming portion moving up and down with respect to the cleaning implement results in maintaining as much as possible the state in which the lower edge of the sweep-up slope surface is opposed to the cleaning subject surface, while reliably sweeping up the dust on the cleaning subject surface along the sweep-up slope surface by the rotation of the rotative brush. Thus, if the slope surface forming portion were fixed to the cleaning implement without moving up and down, the cleaning implement would be pushed up together with the slope surface forming portion by the raised area of the cleaning subject surface, so that the rotative brush or the wiping member supported by the wiping member support bottom would float from the cleaning subject surface; however, it is possible to prevent such floating, thus preventing a decrease in the cleaning effectiveness. Specifically, it is possible, for example, to form the opposite end portions of the slope surface forming portion respectively with at least a pair of upper and lower projections or vertical ridges while forming the base body of the cleaning implement with substantially vertical guide grooves adapted to fit on the pair of upper and lower projections or vertical ridges, the vertical length of the guide grooves being greater than the vertical end distance between the projections or ridges, whereby the projections or ridges are guided to allow the slope surface forming portion to move up and down. Further, the projections or ridges may be formed on the base body and the substantially vertical grooves may be formed in the slope surface forming portion.

The dust swept up by the rotation of the rotative brush is separated from the rotative brush by the centrifugal force or by a comb-like portion in the case where such comb-like portion or the like is provided for combing the rotative brush (for separation of dust and the like entwined around the rotative brush) or the like and received in dust receiver.

The wiping member support bottom is disposed laterally of the rotative brush (in one or both directions orthogonal to the rotation axis of the rotative brush), supporting the wiping member in such a manner as to be capable of pressing it against the cleaning subject surface. As for the wiping member, a sheet-like wiping member, such as a non-woven fabric, a pile fabric (for example, that having cut pile and/or loop pile of very fine fiber), etc., preferably a sheet-like wiping member, more preferably a sheet-like wiping member of non-woven fabric may be used in a dry state or in a moistened state using water or other liquid. Particularly, when a sheet-like wiping member is used as the wiping member, the bottom surface side of the wiping member support bottom is preferably made of a material having a cushioning property, such as foam plastic, sponge rubber or the like. In addition, the rotative brush, while supporting the wiping member on the wiping member support bottom to abut against the cleaning subject surface, is rotatably supported so that at least the lower end of the rotative brush contacts the cleaning subject surface.

The wiping member fixer is used to removably fix the wiping member while supporting the wiping member on the wiping member support bottom, and may be installed in one or more places. In the case of using a sheet-like wiping member, said wiping member support bottom can support said sheet-like wiping member in such a manner as to press it against the cleaning subject surface, and it is necessary that the wiping member fixer be capable of removably fixing the sheet-like wiping member while supporting the sheet-like wiping member on said wiping member support bottom.

The wiping member fixer may, for example, be a clip capable of removably pressure-holding the wiping member, a Hook-and-Loop fastener (surface fastener) capable of holding the wiping member, a holder capable of holding the wiping member between the pointed ends of a plurality of elastic tongue pieces capable of elastically bending in the direction of thickness or between an elastic tongue piece capable of elastically bending in the direction of thickness and a rigid portion, a raised portion and a recessed portion in the holder pressure-holding the wiping member between the recessed portion and the raised portion to fit therein, a holder capable of holding the wiping member preferably by hooking it on a plurality of rigid pointed ends (for example, saw teeth), an adhesive portion using an adhesive agent or the like, a portion to which an adhesive portion disposed on the wiping member can removably adhere, or the like; one or more of these may be installed in dot, line or plane form.

In the case of a relatively thick wiping member of pile fabric or the like, for example, one surface that constitutes a Hook-and-Loop fastener may be placed on the upper surface of the wiping member over a wide area, while placing the other in the corresponding position in the wiping member support bottom to serve as the wiping member fixer.

In the case of a sheet-like wiping member such as a sheet-like wiping member of non-woven fabric, or also in other wiping members, for example, one end of the wiping member may be fixed between the wiping member support bottom and the rotative brush or may be fixed to the wiping member fixer disposed in that position on the near portion, to the rotative brush, of the wiping member support bottom, while the other end may be fixed to the wiping member fixer disposed in that position on the far portion, from the rotative brush, of the wiping member support bottom or disposed in a position spaced away to the reverse side from the wiping member support bottom as seen from the lower end of the rotative brush (for example, the upper surface disposed in the upper position farther from the wiping member support bottom or disposed above the wiping member support bottom).

Particularly, in the case of using a sheet-like wiping member such as a sheet-like wiping member of non-woven fabric (not excluding other wiping members), it is preferable to have a wiping member fixer capable of removably fixing the end of the wiping member on the rotative brush side supported by the wiping member support bottom, between the rotative brush and the wiping member support bottom or above the portion, which is near to the rotative brush, of the wiping member support bottom. This ensures that when the cleaning implement is being moved on the cleaning subject surface with the wiping member support bottom following after the rotative brush in a direction orthogonal to the rotation axis of the rotative brush, it is possible to avoid the situation in which the front end of the wiping member (particularly, sheet-like wiping member) is curled by friction with the cleaning subject surface to become unusable.

In this case, it is possible to have a wiping member holding groove parallel with the rotation axis of the rotative brush and open downward between the rotative brush and the wiping member support bottom or at the portion, which is near to the rotative brush, of the wiping member support bottom, with the wiping member fixer disposed in said wiping member holding groove. As for the wiping member fixer in this case, any of the examples shown above may be used. Particularly, use of a wiping member holding ridge adapted to removably fit in the wiping member holding groove makes it possible to pressure-hold one end of the wiping member (particularly, a sheet-like wiping member) between the two during the fitting of the two, in which case, the wiping member holding groove itself constitutes a wiping member fixer.

Further, when it is moved in the direction opposite to what is shown above (that is, when the cleaning implement is moved on the cleaning subject surface with the rotative brush following after the wiping member support bottom in a direction orthogonal to the rotation axis of the rotative brush), it is preferable to have the wiping member fixer with the other end disposed in an upper position spaced away to the reverse side from the wiping member support bottom as seen from the lower end of the rotative brush, in order to avoid the situation in which the other end of the wiping member (particularly, sheet-like wiping member) is curled by friction with the cleaning subject surface to become unusable.

Further, the cleaning implement of the invention may be such that it includes a support bottom constituting member constituting at least a portion of the wiping member support bottom, said support bottom constituting member having a rotation axis (preferably on the side far from or near to the rotative brush) parallel with the rotation axis of the rotative brush, being adapted to be opened and closed by the turning around the axis of the turn shaft, and having the wiping member fixer placed on the upper side thereof, wherein with the support bottom constituting member closed, the wiping member support bottom supports the wiping member in such a manner that the latter can be pressed against the cleaning subject surface. The support bottom constituting member may be supported, for example, at its upper surface by the bottom plate of the dust receiver. Any of the examples given above may be used as the wiping member fixer. Particularly, if a wiping member holding ridge or a wiping member holding projection plate adapted to removably fit in said wiping member holding groove is provided in the end of the support bottom constituting member, one end of the wiping member (particularly, a sheet-like wiping member) can be pressure-held between the two during the fitting of the two, in which case, the wiping member holding ridge constitutes a wiping member fixer. In addition, in such case, it is also possible to provide an additional wiping member fixer using an adhesive agent, elastic tongue or the like on the bottom surface of the support bottom constituting member constituting at least a portion of the wiping member support bottom.

The separator is used to separate the wiping member supported by the wiping member support bottom from the rotative brush, and it is preferable to have said slope surface forming portion as at least a portion of the separator. More preferably, the slope surface forming portion is vertically movably supported so that it is capable of moving upward when pushed up by a raised area on the cleaning subject surface and of returning to its original position when the push-up action is removed. However, besides such slope surface forming portion, it is possible to use a wall, a partition wall, a downwardly projecting ridge, or the like as the separator.

The mode for embodying the invention will now be described with reference to FIGS. 1 through 11.

FIGS. 1 through 7 show an example of a cleaning implement according to the invention.

This cleaning implement has a substantially box-shaped base body 10 that comprises a dust receiver 10*a*, an elastic tongue piece holding body attaching plate 10*b*, a brush cover 10*c*, a front rising portion 10*d*, a slope surface forming portion 10*e*, and a wiping member holding groove 10*f*, said base body being provided with a rotative brush 12, driving wheels 14, a cover 16, a support bottom constituting member 20, an elastic tongue piece holding body 22, and a handle support body 23.

The brush cover 10*c* is positioned in the front (the left-hand end in FIG. 1) of the base body 10. Under the brush cover 10*c*, the rotative brushes 12 are rotatably supported at opposite ends of the rotative shaft 12*a*, with the driving wheels 14 coaxially fixed on the opposite ends of the rotative shaft 12*a* extending horizontally (in the direction normal to the plane of FIG. 1). The outer periphery enveloping surface of the rotative brush 12 somewhat projects outward beyond the outer peripheral surface of the driving wheel 14.

The slope surface forming portion 10*e* constitutes a sweep-up slope surface 10*e*1 whose front surface extends substantially along the outer periphery of the rear lower portion substantially throughout the length of the rotative brush 12, with the lower end of the sweep-up slope surface 10*e*1 opposed to a cleaning subject surface 26. The slope surface forming portion 10*e* is plate-shaped, extending in parallel with the rotative shaft 12*a* of the rotative brush 12 and curved as seen in a side view.

The dust receiver 10*a* is box-shaped, positioned rearwardly of the rotative brush 12 in the base body 10, with the upper portion of the front rising portion 10*d* thereof leading to the rear upper portion of the rotative brush 12. The top of the dust receiver 10*a* is opened and shut by the cover 16 providing a rotative shaft at the front end. A comb-like portion 18 is formed at the front lower portion of the cover 16 and at the position where the comb-like portion 18 combs the rotative brush 12 while the cover 16 is shut as shown in FIG. 1.

A downwardly opened wiping member holding groove 10*f* parallel with the rotative shaft 12*a* of the rotative brush 12 is formed between the slope surface forming portion 10*e* and the front rising portion 10*d*.

The rear end of the base body 10 is formed with a vertical plate-like elastic tongue piece holding body attaching plate 10*b*, with a space 10*h* defined between said rear end and the rear of the dust receiver 10*a*. Fixedly fitted respectively in fitting holes formed in the right and left regions of the elastic tongue piece holding body attaching plate 10*b* are elastic tongue piece holding bodies 22. Each elastic tongue piece holding body 22 is fan-shaped, in the form of an elliptic plate divided at its center into six sectors, parallel with the elastic tongue piece holding body attaching plate 10*b*, comprising elastic tongue pieces 22*a* fixed at their base to the outer periphery and elastically bendable on their pointed end side in the direction of the thickness.

The support bottom constituting member 20 is in the form of a flat plate extending substantially throughout the width of the base body 10, having a cushion 20*a* throughout the surface on the lower surface side, connected to the rear end lower portion of the base body 10 at the turn shaft 20*c* parallel with the rotation axis of the rotative brush 12 in the rear end, and capable of opening and closing by turning around the axis of the turn shaft 20*c*. The support bottom constituting member 20 has a wiping member holding projection plate 20*b* projecting upward from the front end thereof. In the closed state of the support bottom constituting member 20, the cushion 20*a* thereof constitutes the wiping member support bottom. The operating portions 20*d* disposed on the right and left sides of the support bottom constituting member 20 prevent the operator's fingers from slipping and facilitate opening and closing operation of the support bottom constituting member 20.

Figure 3:
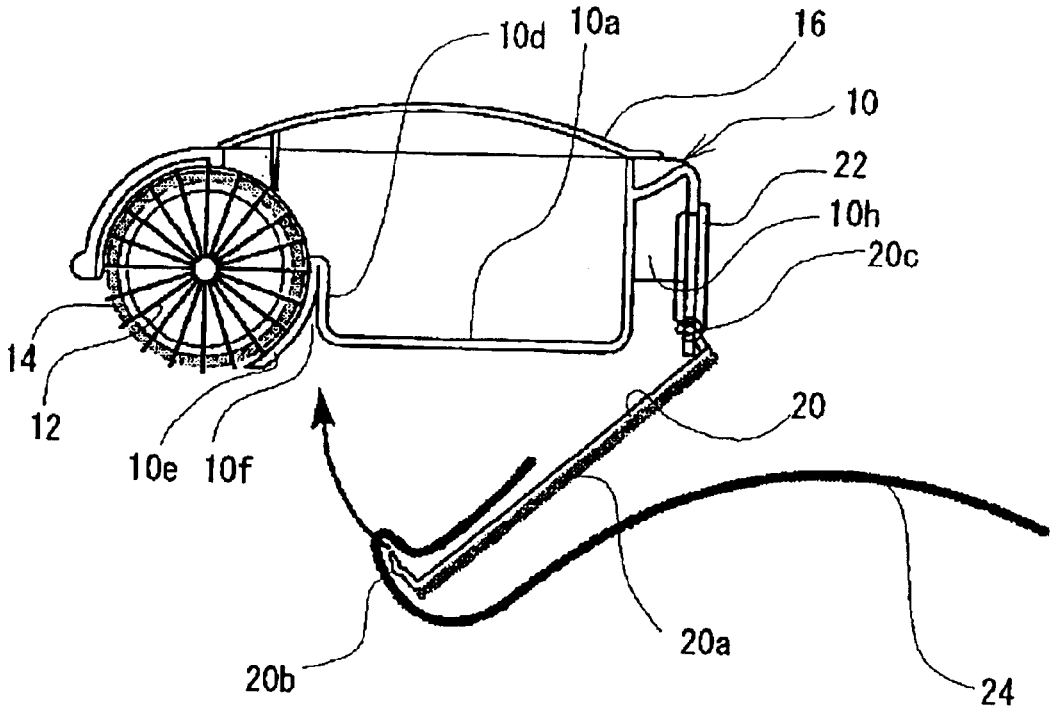
FIG. 3 is an explanatory view, in section, of the cleaning implement, with the front edge of a wiping member being attached.
Figure 4:
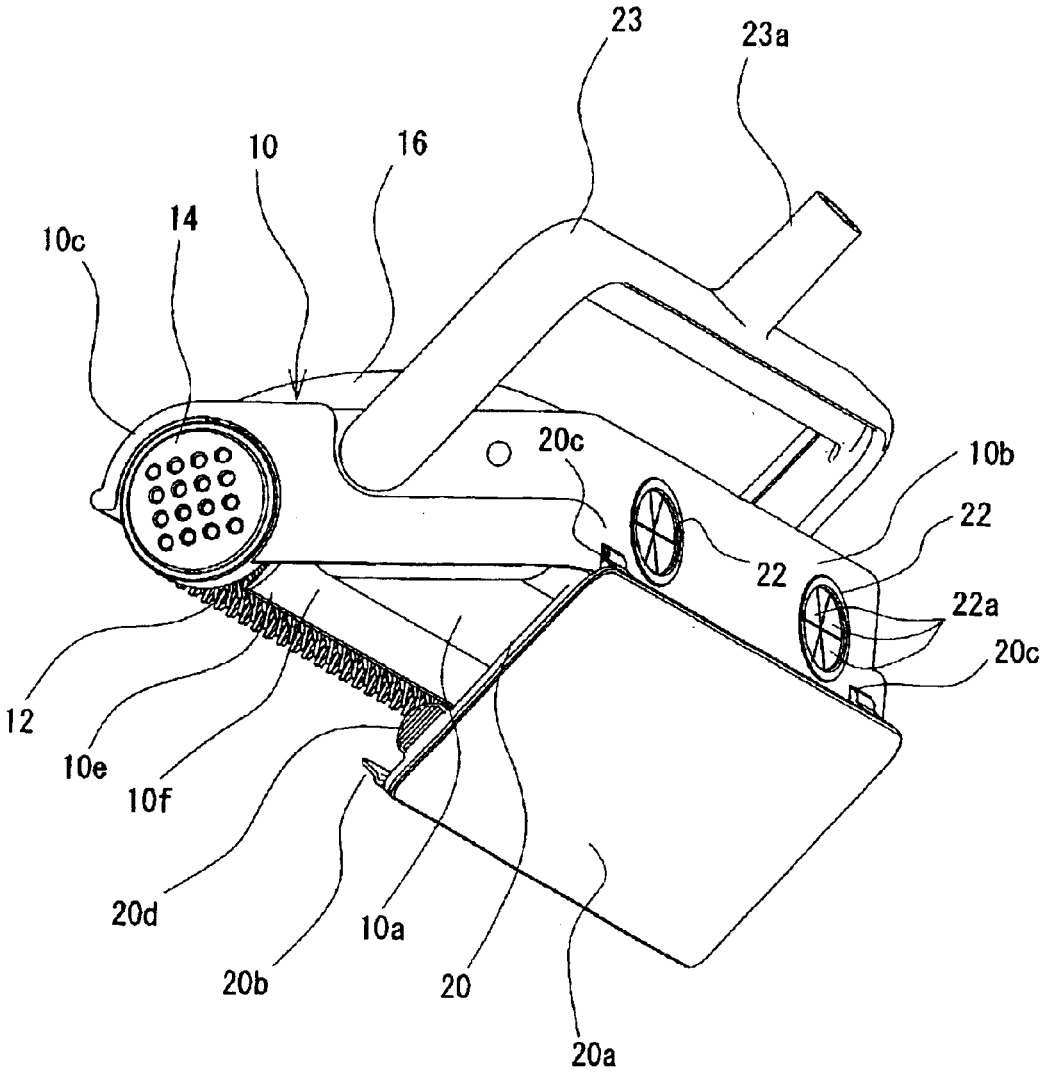
FIG. 4 is a perspective view looking at the rear of the cleaning implement from below during attachment of a wiping member.
Figure 5:
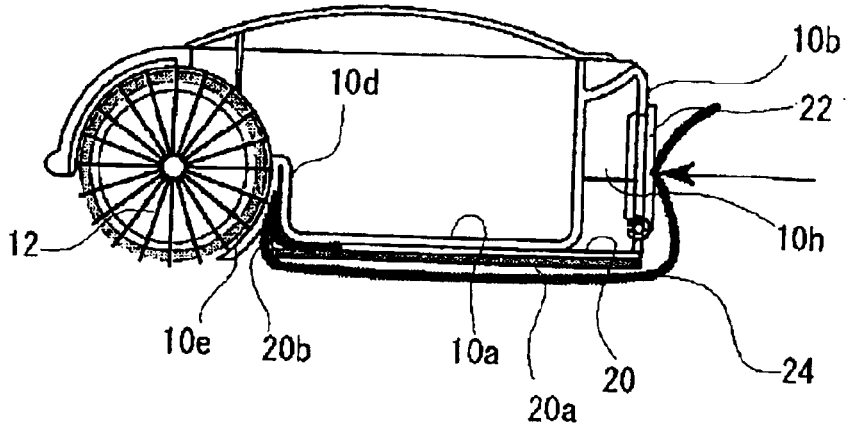
FIG. 5 is an explanatory view, in section, of the cleaning implement, with the rear edge of a wiping member being attached.

In the opened state of the support bottom constituting member 20, a rectangular (not limited thereto), non-woven fabric sheet-like wiping member 24 has its front edge covered over the front and rear sides of the wiping member holding projection plate 20*b* and the support bottom constituting member 20 is turned, as shown by the arrow in FIG. 3, to fixedly fit the wiping member holding projection plate 20*b* in the wiping member holding groove 10*f* from below, whereby the front edge of the sheet-like wiping member 24 is pressure-held between the wiping member holding projection plate 20*b* and the wiping member holding groove 10*f*. Thereafter, as shown in FIG. 5, the right and left regions of the rear edge of the sheet-like wiping member 24 are pushed into the elastic tongue piece holding bodies 22 from behind, whereby the rear edge of the sheet-like wiping member 24 is held between the pointed ends of the elastic tongue pieces 22*a*. Thus, as shown in FIG. 1, the upper surface of the flat plate-like portion of the support bottom constituting member 20 is supported on the bottom surface of the dust receiver 10*a*, and the sheet-like wiping member 24 so supported under the cushion 20*a* of the support bottom constituting member 20 as to be capable of pressing against the cleaning subject surface 26 is fixedly held by the cleaning implement. In addition, disposing the elastic tongue piece holding bodies 22, for example, on the upper surface of the base body 10 also makes it possible to fixedly hold the rear edge of the sheet-like wiping member 24 on the rear upper surface of the cleaning implement. Further, the wiping member holding projection plate 20*b* in FIGS. 3 and 4 is shown provided with a projection on the front side, said projection being adapted to fit in a recess (not shown) formed in the rear surface of the slope surface forming portion 10*e* (the right-hand surface in FIG. 3), whereby the state in which the wiping member holding projection plate 20*b* is fixedly fitted in the wiping member holding groove 10*f* is made reliable.

The handle support body 23 has its bifurcated opposite ends turnably attached to the base body 10 and has a handle connecting portion 23*a* in the middle that is capable of having the handle fixedly fitted therein.

Figure 2:
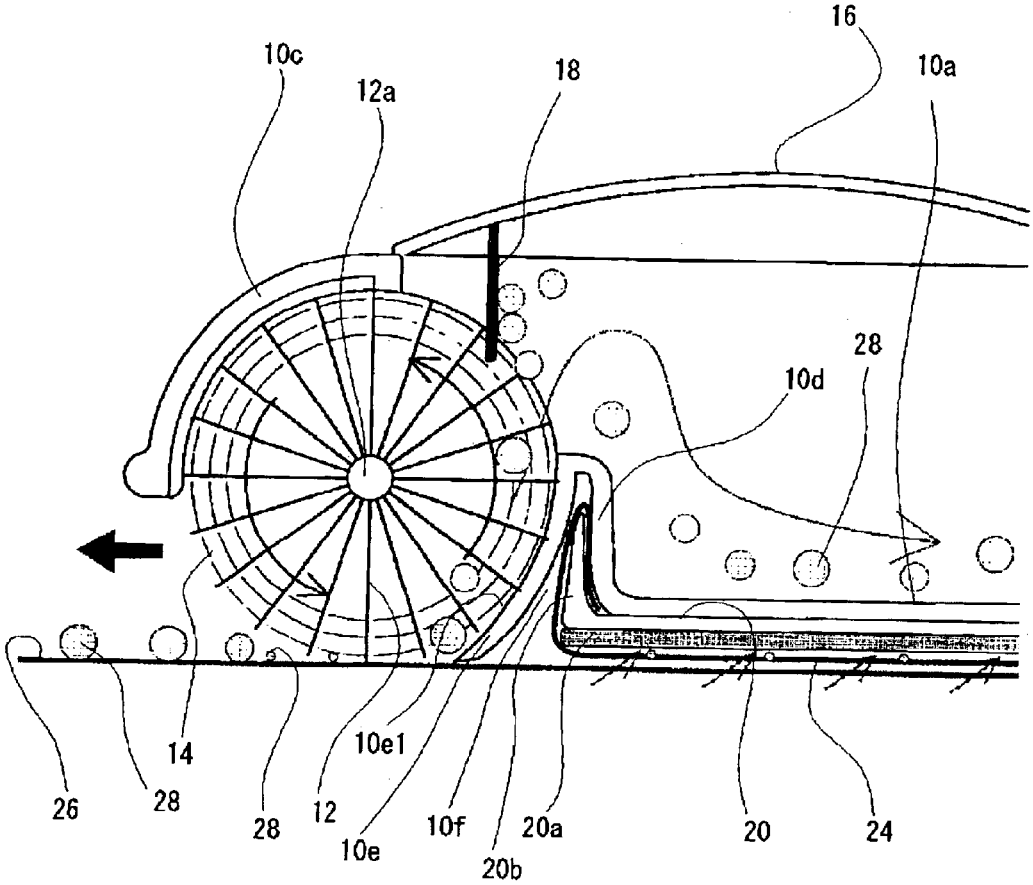
FIG. 2 is an enlarged view of the principal portion of FIG. 1.

When the cleaning implement having the sheet-like wiping member 24 attached thereto is placed on the cleaning subject surface 26, the sheet-like wiping member 24 abuts against the cleaning subject surface 26 and the lower end of the rotative brush 12 contacts the cleaning subject surface 26. The cleaning implement is advanced in this state as indicated by the arrow in FIGS. 1 and 2, so that as the driving wheels 14 roll on the cleaning subject surface 26, the rotative brush 12 rotates counterclockwise as seen in FIGS. 1 and 2; thus, while being guided by the sweep-up slope surface 10*e*1 of the slope surface forming portion 10*e*, the dust 28 on the cleaning subject surface 26 is swept up by the rotation of the rotative brush 12. The dust 28 is separated from the rotative brush 12 by the centrifugal force due to rotation of the rotative brush 12 and the combing action of a comb-like portion 18 on the rotative brush 12 and is received in the dust receiver 10*a* leading to the upper rear region of the rotative brush 12. Substantially at the same time as this, the cleaning subject surface 26 can be wiped while pressing the sheet-like wiping member 24 supported on the cushion 20*a* of the support bottom constituting member 20 against the cleaning subject surface 26. This means that the area of the floor surface from which those relatively large dust particles 28 on the cleaning subject surface 26 which can decrease the efficiency of wiping out relatively fine dust particles 28 are swept out is wiped by the sheet-like wiping member 24, so that the cleaning of the cleaning subject surface 26 can be efficiently and reliably effected. The sheet-like wiping member 24, which is removably fixed in position as it is supported on the cushion 20*a*, can be exchanged whenever necessary and used, and since the rotative brush 12 and sheet-like wiping member 24 are separated from each other by the slope surface forming portion 10*e*, the sheet-like wiping member 24 is prevented from being damaged and decreased in durability by the rotation of the rotative brush 12.

Figure 6:
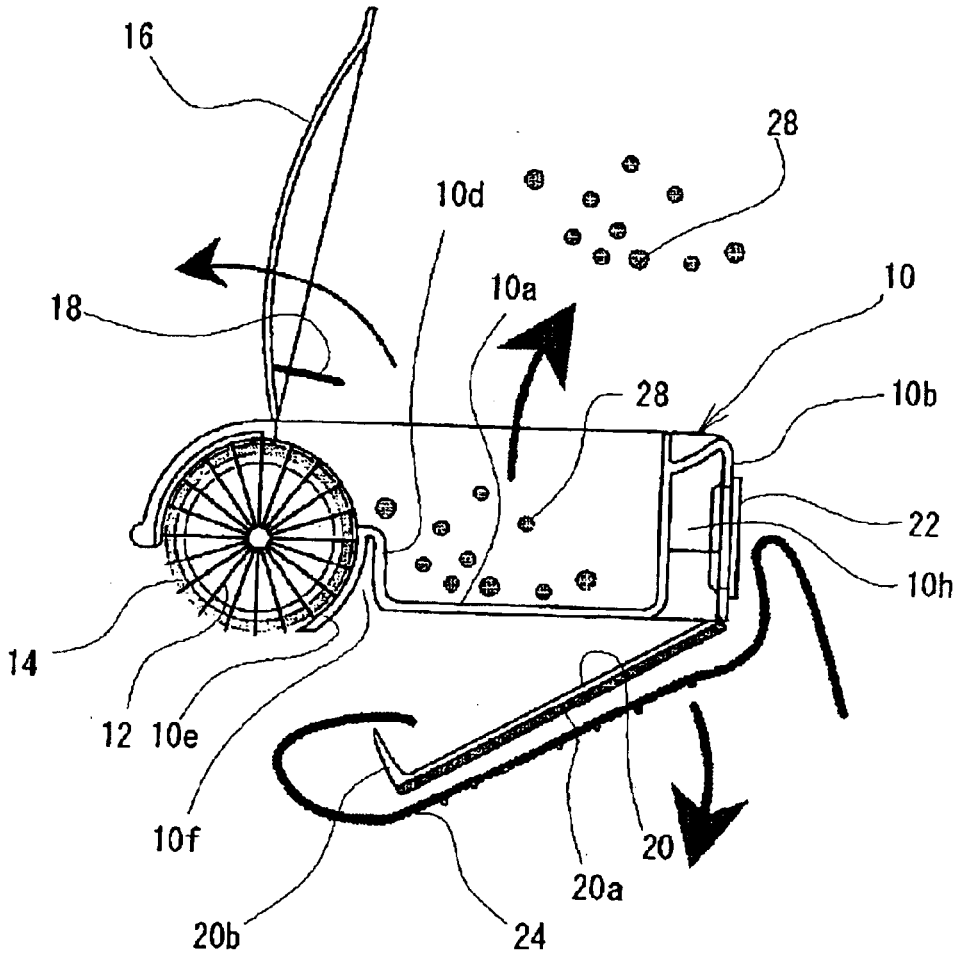
FIG. 6 is an explanatory view, in section, of the cleaning implement, with the wiping member being removed and the dust being discharged.
Figure 7:
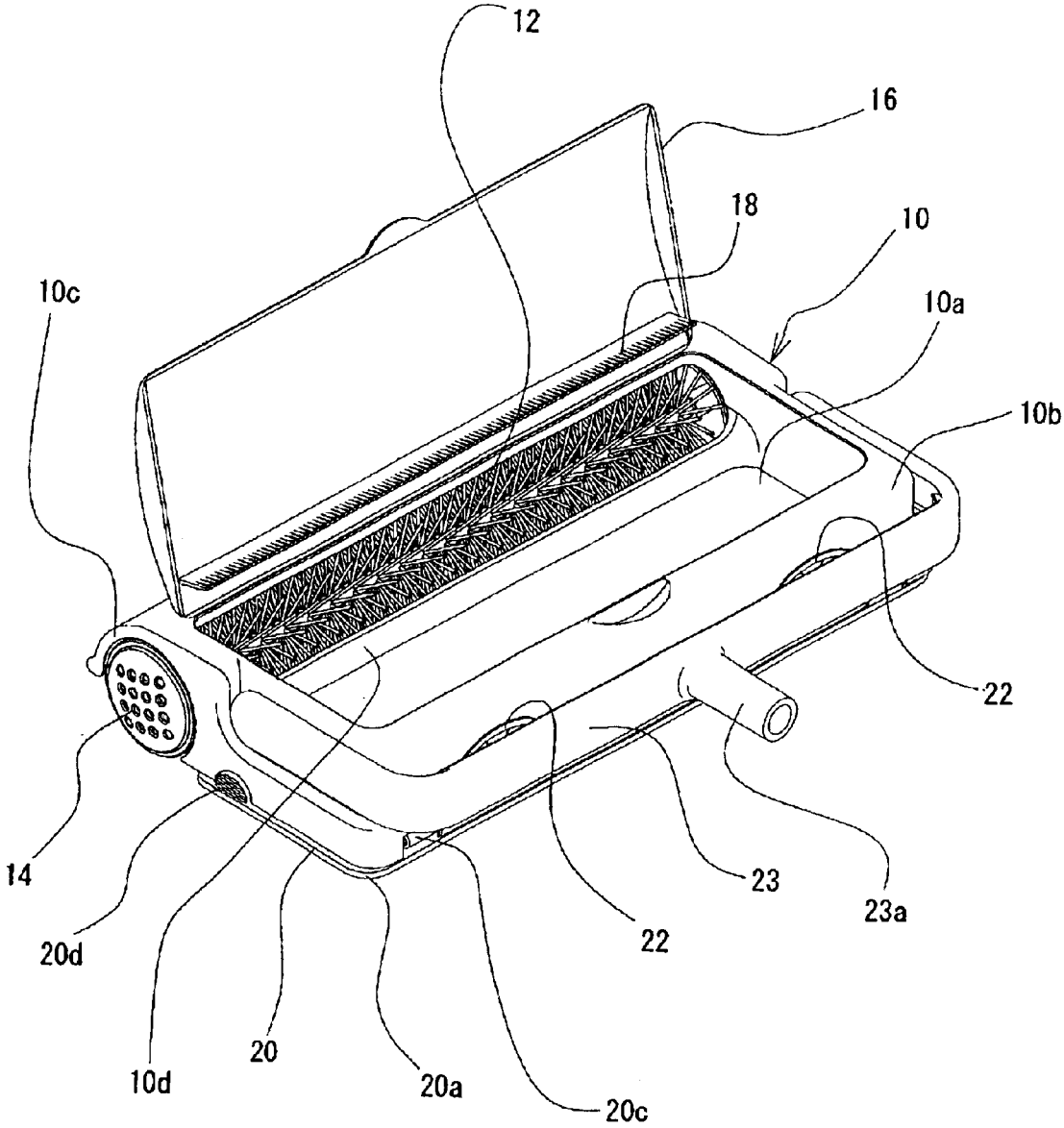
FIG. 7 is a perspective view looking at the rear of the cleaning implement from above, with the dust being discharged.

After the sheet-like wiping member 24 has been fully used, the support bottom constituting member 20 is turned as indicated by the arrow in FIG. 6 to remove the wiping member holding projection plate 20*b* from the wiping member holding groove 10*f*, thereby releasing the front edge of the sheet-like wiping member 24 from fixed holding, and removing the rear edge of the sheet-like wiping member 24 from the elastic tongue piece holding bodies 22; thus, the sheet-like wiping member 24 can be removed from the cleaning implement. Further, as shown in FIG. 6, the dust 28 received in the dust receiver 10*a* can be discharged by opening the cover 16.

Figure 8:
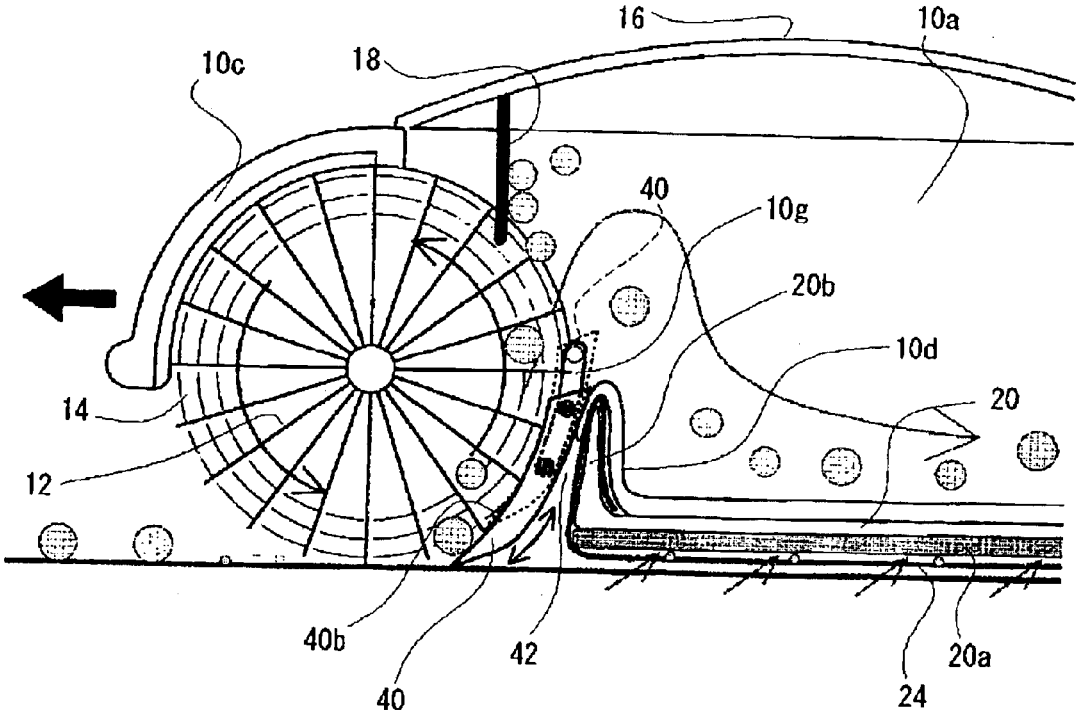
FIG. 8 is an enlarged explanatory view, in cross section, of the principal portion of the cleaning implement in operation.
Figure 9:
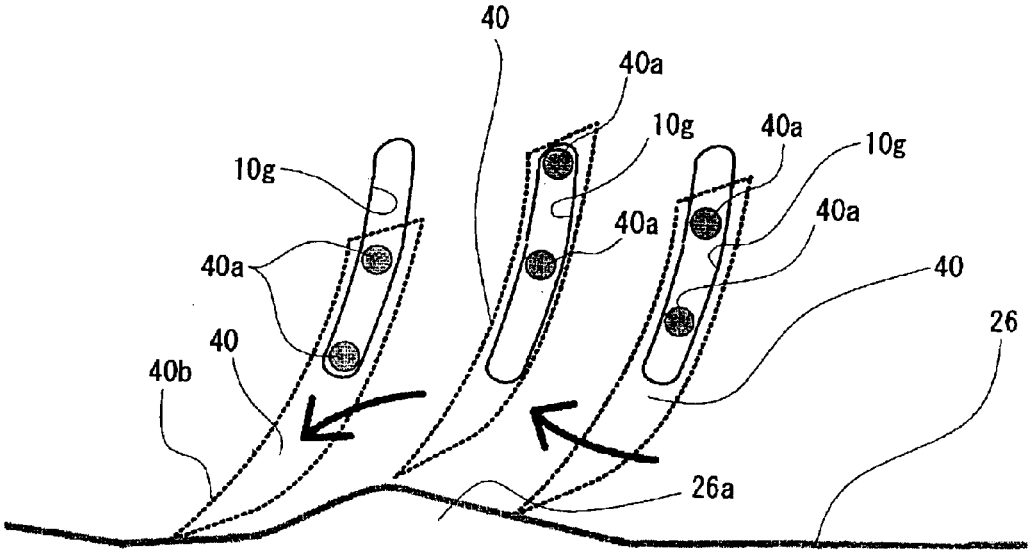
FIG. 9 is an enlarged explanatory view of the principal portion.

FIGS. 8 and 9 show another example of the cleaning implement of the invention.

A slope surface forming portion 40 in this example has a pair of upper and lower projections 40*a* laterally projecting from the opposite ends, while the base body 10 of the cleaning implement is formed with substantially vertical guide grooves 10*g* for fitting on the pair of upper and lower projections 40*a*, the vertical length of the guide grooves 10*g* being greater than the vertical end distance between the two projections 40*a* so as to allow the slope surface forming portion 40 to vertically move as the projections 40*a* are guided in the guide grooves 10*g*. The slope surface forming portion 40 forms, at its front surface, a sweep-up slope surface 40*b* extending substantially along the outer periphery of the rear lower portion of the rotative brush 12 substantially throughout the length thereof, the lower end of the sweep-up slope surface 40*b* being opposed to the cleaning subject surface 26. The slope surface forming portion 40 is in the form of a plate extending in parallel with the rotative shaft 12*a* of the rotative brush 12 and curved in a side view.

This slope surface forming portion 40 is capable of moving upward when pushed up by a raised area 26*a* on the cleaning subject surface 26 and of returning to its original position when the push-up action is removed. In this case, the slope surface forming portion 40 moving up and down with respect to the cleaning implement results in maintaining as much as possible the state in which the lower end of the sweep-up slope surface 40*b* is opposed to the cleaning subject surface 26, while reliably sweeping up the dust 28 on the cleaning subject surface 26 along the sweep-up slope surface 40*b* by the rotation of the rotative brush 12. Thus, if the slope surface forming portion were fixed to the cleaning implement without moving up and down, the cleaning implement would be pushed up together with the slope surface forming portion 40 by the raised area 26*a* of the cleaning subject surface 26, so that the rotative brush 12 or the sheet-like wiping member 24 supported by the cushion 20*a* of the support bottom constituting member 20 would float from the cleaning subject surface 26; however, it is possible to prevent such floating, thus preventing a decrease in the cleaning effectiveness.

Figure 10:
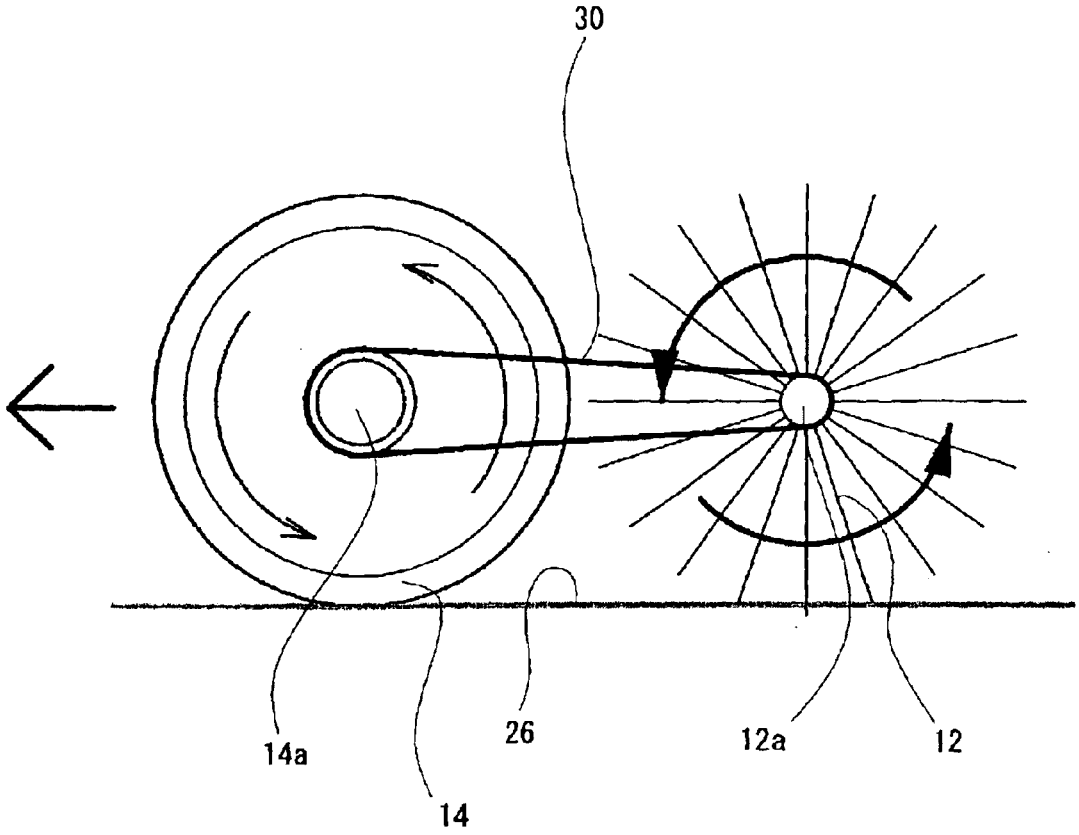
FIG. 10 is an explanatory view showing another mode of driving the rotative brush in the cleaning implement of the invention.

FIG. 10 shows another mode of driving the rotative brush in the cleaning implement of the invention. In this case, the rotative shaft 14*a* of the driving wheel 14 and the rotative shaft 12*a* of the rotative brush 12 are individually supported for rotation, and the diameter of the rotative shaft 14*a* of the driving wheel 14 are made larger than that of the rotative shaft 12*a* of the rotative brush 12, with an endless belt 30 entrained around the rotative shafts 14*a* and 12*a*, whereby the two are operatively associated with each other to make the rpm (angular velocity) of the rotative brush 12 greater than that of the driving wheel 14 so as to increase the sweep-up efficiency. In addition, in FIG. 10, the driving wheel 14 and the rotative brush 12 are longitudinally spaced apart from each other; however, it is, of course, possible to position the rotative shaft 12*a* of the rotative brush 12 within the radius of the driving wheel 14.

Figure 11:
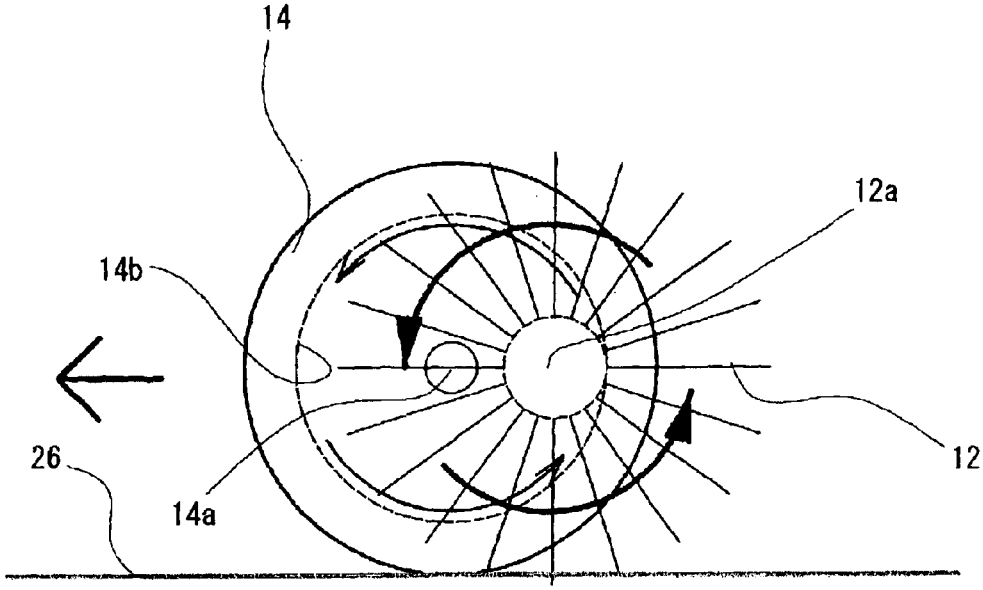
FIG. 11 is an explanatory view showing still another mode of driving the rotative brush in the cleaning implement of the invention.

FIG. 11 shows still another mode of driving the rotative brush in the cleaning implement of the invention. In this case, the inner periphery of the outer wheel portion of the driving wheel 14 is formed with teeth 14*b*, while the outer periphery of the rotative shaft 12*a* of the rotative brush 12 is formed with teeth meshing with the teeth 14*b*, whereby the two are operatively associated with each other to make the rpm (angular velocity) of the rotative brush 12 greater than that of the driving wheel 14 so as to increase the sweep-up efficiency.

In addition, the vertical positional relation used in the description of the mode for carrying out given above is simply for the convenience of explanation based on the drawings, not intended to limit the conditions, etc., for actual use.

The explanation including examples and numerical value ranges describing the invention in the item "means for solving the problems" is applied, in principle, to the description of the mode for carrying out given above.

What is claimed is:

1. A cleaning implement comprising a rotative brush supported for rotation around a horizontal rotation axis, a driving device for rotatively driving the rotative brush, a dust receiver for receiving dust swept up by the rotation of the rotative brush, a wiping member support bottom for supporting a sheet wiping member in such a manner the latter can be pressed against a cleaning subject surface, and a wiping member fixer for removably fixing the wiping member while supporting the latter on the wiping member support bottom, wherein said wiping member support bottom is disposed laterally of said rotative brush, said rotative brush, while supporting the wiping member on said wiping member support bottom to abut the wiping member against the cleaning subject surface, is supported with at least a lower end thereof in contact with the cleaning subject surface, said cleaning implement having a separator for separating the wiping member supported by said wiping member support bottom and said rotative brush.

2. A cleaning implement of claim 1, wherein the wiping member fixer is disposed between said rotative brush and wiping member support bottom or above a portion of the wiping member support bottom, said portion being near to the rotative brush, and is capable of removably fixing the rotative brush side end of the wiping member supported by the wiping member support bottom.

3. A cleaning implement of claim 2, including a wiping member holding groove parallel with the rotation axis of said rotative brush and open downward between the rotative brush and wiping member support bottom or at the portion of the wiping member support bottom, the portion being near to the rotative brush, said wiping member holding groove having the wiping member fixer.

4. A cleaning implement of claim 3, including a support bottom constituting member constituting at least a portion of the wiping member support bottom, said support bottom constituting member having a rotation axis parallel with the rotation axis of the rotative brush, being adapted to be opened and closed by the turning around the axis of the rotation axis, and having the wiping member fixer placed on the upper side thereof, wherein with the support bottom constituting member closed, the wiping member support bottom supports the wiping member in such a manner that the latter can be pressed against the cleaning subject surface.

5. A cleaning implement as described in claim 3, wherein said wiping member support bottom is able to support a sheet-like wiping member in such a manner that the sheet-like wiping member can be pressed against the cleaning subject surface and said wiping member fixer, while supporting said sheet-like wiping member on said wiping member support bottom, can removably fix said sheet-like wiping member.

6. A cleaning implement of claim 3, including a slope surface forming portion that extends substantially along the outer periphery of the rotative brush to define a sweep-up slope surface opposed at its lower end to a cleaning subject surface, and forming at least a portion of said separator.

7. A cleaning implement claim 2, including a support bottom constituting member constituting at least a portion of the wiping member support bottom, said support bottom constituting member having a rotation axis parallel with the rotation axis of the rotative brush, being adapted to be opened and dosed by the bring around the axis of the rotation axis, and having the wiping mentor fixer placed on the upper side thereof, wherein with the support bottom constituting member closed, the wiping member support bottom supports the wiping member in such a manner that the latter can pressed against the cleaning subject surface.

8. A cleaning implement as described in claim 2, wherein said wiping member support bottom is able to support a sheet-like, wiping member in such a manner that the sheet-like wiping member can be pressed against the cleaning subject surface, and said wiping member fixer, while supporting said sheet-like wiping member on said wiping member support bottom, can removably fix said sheet-like wiping member.

9. A cleaning implement of claim 2, including a slope surface forming portion that extends substantially along the outer periphery of the rotative brush to define a sweep-up slope surface opposed at its lower end to a cleaning subject surface, and forming at least a portion of said separator.

10. A cleaning implement of claim 1, including a support bottom constituting member constituting at least a portion of the wiping member support bottom, said support bottom constituting member having a rotation axis parallel with the rotation axis of the rotative brush, being adapted to be opened and closed by the turning around the axis of the rotation axis, and having the wiping member fixer placed on the upper side thereof, wherein with the support bottom constituting member closed, the wiping member support bottom supports the wiping member in such a manner that the latter can be pressed against the cleaning subject surface.

11. A cleaning implement as described in claim 10, wherein said wiping member support bottom is able to support a sheet-like wiping member in such a manner that the sheet-like wiping member can be pressed against the cleaning subject surface, and said wiping member fixer, while supporting said sheet-like wiping member on said wiping member support bottom, can removably fix said sheet-like wiping member.

12. A cleaning implement of claim 10, including a slope surface forming portion that extends substantially along the outer periphery of the rotative brush to define a sweep-up slope surface opposed at its lower end to a cleaning subject surface, and forming at least a portion of said separator.

13. A cleaning implement as described in claims 1, wherein said wiping member support bottom is able to support a sheet-like wiping member in such a manner that the sheet-like wiping member can be pressed against the cleaning subject surface, and said wiping member fixer, while supporting said sheet-like wiping member on said wiping member support bottom, can removably fix said sheet-like wiping member.

14. A cleaning implement of claim 13, including a slope surface forming portion that extends substantially along the outer periphery of the rotative brush to define a sweep-up slope surface opposed at its lower end to a cleaning subject surface, and forming at least a portion of said separator.

15. A cleaning implement of claim 1, including a slope surface forming portion that extends substantially along the outer periphery of the rotative brush to define a sweep-up slope surface opposed at its lower end to a cleaning subject surface, and forming at least a portion of said separator.

16. A cleaning implement of claim 15, wherein the slope surface forming portion is vertically movably supported so that it can be moved upward as it is pushed up by a projection on the cleaning subject surface and so that it can be returned to its original position by canceling the push-up.

* * * * *